US006988458B1

(12) United States Patent
Walker

(10) Patent No.: US 6,988,458 B1
(45) Date of Patent: Jan. 24, 2006

(54) BOAT WASHING AND TOWING DEVICE

(76) Inventor: Wayne P. Walker, 3129 19th St. North West, Washington, DC (US) 20017

( * ) Notice: Subject to any disclaimer, the term of this patent is extended or adjusted under 35 U.S.C. 154(b) by 29 days.

(21) Appl. No.: 10/956,700

(22) Filed: Sep. 29, 2004

(51) Int. Cl.
*B63B 59/00* (2006.01)

(52) U.S. Cl. ..... 114/222

(58) Field of Classification Search ..... 114/222, 114/253; 440/38
See application file for complete search history.

(56) References Cited

U.S. PATENT DOCUMENTS

| | | | | |
|---|---|---|---|---|
| 3,227,124 | A * | 1/1966 | Campbell | 114/222 |
| 3,561,391 | A | 2/1971 | Locati | |
| 3,709,184 | A | 1/1973 | Laney | |
| 3,752,109 | A * | 8/1973 | Seiple | 114/222 |
| 3,800,732 | A | 4/1974 | Hill | |
| 4,030,440 | A | 6/1977 | Wickersham | |
| 4,043,286 | A | 8/1977 | Doty | |
| 4,204,494 | A | 5/1980 | Bridwell et al. | |
| 4,236,477 | A | 12/1980 | Norris et al. | |
| 4,843,995 | A | 7/1989 | Bingham | |
| 5,222,452 | A | 6/1993 | Maloney et al. | |
| D349,368 | S | 8/1994 | Haskins | |
| 5,638,764 | A | 6/1997 | Sarvela | |
| 5,988,093 | A * | 11/1999 | Ni | 114/222 |

* cited by examiner

*Primary Examiner*—Stephen Avila

(57) ABSTRACT

A device includes a plurality of buoyant support members having a plurality of cavities formed therein and are provided with a plurality of pivotal access panels to access the cavities. A plurality of elongated rocker arms and a plurality of associated scrubbing assemblies are operably attached thereto. Such rocker arms extend inwardly from the support members and are laterally adjustable such that the scrubbing assemblies can be positioned along alternating planes during operating conditions. A plurality of hydraulic separators are positioned between the support members and include associated pistons secured to the support members such that a spatial relationship between the support members can be adjusted. A mechanism, partially disposed in the cavities, is included for effectively discharging a volume of fluid through the scrubbing assemblies towards the boat hull.

18 Claims, 3 Drawing Sheets

BOAT WASHING AND TOWING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a towing and washing device and, more particularly, to a boat washing and towing device for removing undesirable debris from a boat hull.

2. Prior Art

All kinds of vegetation rapidly grows and accumulates on the bottom of boats slowing down the speed of such boats and increasing their fuel consumption. Soiling is prevented primarily by the use of different toxic paints however; the use of such toxic paints is being restricted in several countries because of the environmental detriments thereof. This development has given rise to a vigorous need for an alternate boat washing means.

A proper cleaning of the bottom of a boat can be performed by pulling the boat ashore but this is an expensive measure and very time consuming. The extended exposure of the boat's hull to air and sunlight is also detrimental to its paint finish and can cause a boat to look much older than it really is.

The practice of cleaning a boat manually in the water is well known in the prior art. One attempt at the above-described practice is the development of a manual scrubbing belt. However, such belts suffer from the disadvantage that they must be manually drawn back and forth across the hull's undersurface. This device requires two operators, one situated on each side of the boat to be cleaned. Thus, the device inconveniently can only be used where two operator platforms are available. Such a practice is also time consuming and can be dangerous to the individuals performing the task.

Another problem arising with boats is the issue of proper towing. Many towing means are not sufficiently designed to properly balance a boat in the water, which can lead to hull damage when maneuvering the boat in close quarters common in docks and marinas. Such towing devices are usually also limited in the number of alternately sized watercrafts they can accommodate.

Accordingly, a need remains for a boat washing and towing device in order to overcome the above-noted shortcomings. The present invention satisfies such a need by providing a washing and towing device that is automatic in its cleaning operation, provides hull protection, saves time and money, is effective in use, and adaptable to boats of different sizes. Such a device advantageously eliminates the dangerous task of manually cleaning a boat's hull under water. A clean boat hull ensures that the vessel moves through the water with as little resistance as possible, thus requiring less fuel and saving the boat owner a considerable amount of money. The boat towing and cleaning device will be appreciated by both private owners as well as owners of marinas for whom the device can advantageously generate greater revenues.

BRIEF SUMMARY OF THE INVENTION

In view of the foregoing background, it is therefore an object of the present invention to provide a boat cleaning and towing device. These and other objects, features, and advantages of the invention are provided by a device for removing undesirable debris from a boat hull.

The device includes a plurality of buoyant support members, preferably a plurality of pontoons, sized and shaped for defining a plurality of respective elongated cavities therein. Such support members are adjustably positionable adjacent to the hull while the boat is situated in a body of water. The support members are provided with a plurality of pivotal access panels for conveniently allowing an operator to selectively access the cavities as needed. Each of the support members has a contoured inner surface for effectively adapting to a general shape of the boat hull.

A plurality of elongated rocker arms and a plurality of associated scrubbing assemblies are operably attached thereto. Such rocker arms extend inwardly from the support members and are selectively spaced along a longitudinal length thereof such that the scrubbing assemblies can be effectively supported at front and rear end portions of the support members. The rocker arms are laterally adjustable such that the scrubbing assemblies can advantageously be positioned along alternating planes during operating conditions. The scrubbing assemblies may include a plurality of adjustable panels and a plurality of brushes operably connected thereto. Such panels are pivotal between a plurality of quadrants so that the brushes can advantageously be adapted to the boat hull's outer surface. The scrubbing assemblies are independently operable such that an operator can effectively maintain continuous surface contact with the outer surface during unstable swaying conditions.

A plurality of hydraulic separators are positioned between the support members adjacent to the front and rear end portions thereof. Such hydraulic separators include associated pistons secured to the support members and telescopically extendable along a substantially horizontal plane such that a spatial relationship between the support members can be selectively adjusted during operating conditions. The separators preferably include a plurality of motors and a plurality of pumps operably connected thereto. Such pumps cooperate with the motors so that a predetermined volume of fluid is selectively deliverable to the separators via a plurality of flexible lines for effectively causing the pistons to oscillate between extended and retracted positions during operating conditions.

A mechanism is included for effectively discharging a predetermined volume of fluid outwardly through the scrubbing assemblies wherein the fluid is directed laterally towards the boat hull for advantageously assisting an operator to remove the debris therefrom. Such a discharging mechanism is partially disposed within the cavities.

The discharging mechanism preferably includes a plurality of motors that has a plurality of drive shafts extending outwardly therefrom. A drive belt is operably connected to the drive shafts and a plurality of water pumps having a plurality of driven shafts connected thereto and positioned adjacent to the drive shafts respectively. Such a mechanism may further include a plurality of drive belts operably connected to the driven shafts and the drive shaft respectively such that the driven shafts are caused to operate in sync with the drive shafts and a plurality of high-pressure water conduits having opposed end portions in fluid communication with the water pumps and the scrubbing members respectively.

The device preferably further includes a plurality of propeller engines mounted adjacent to the rear end portions of the support members respectively. Advantageously, such engines are for allowing an operator to effectively tow the boat between remote locations during non-scrubbing conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
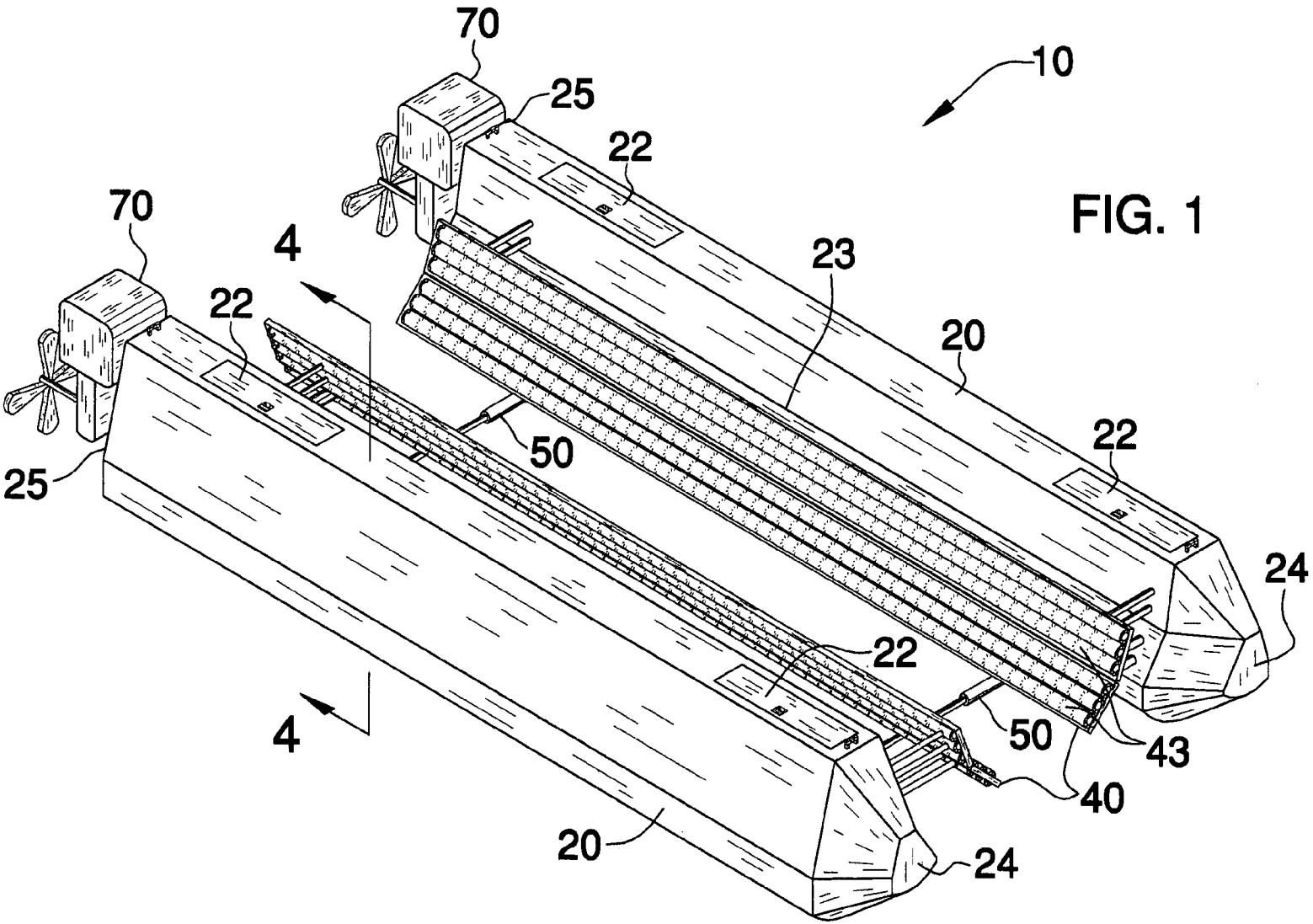
FIG. 1 is a perspective view showing a boat washing and towing device for removing undesirable debris from a boat hull, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–4 by the reference numeral 10 and is intended to provide a boat washing and towing device. It should be understood that the device 10 may be used to wash and tow many different types of boats and should not be limited to only small water craft.

Figure 4:
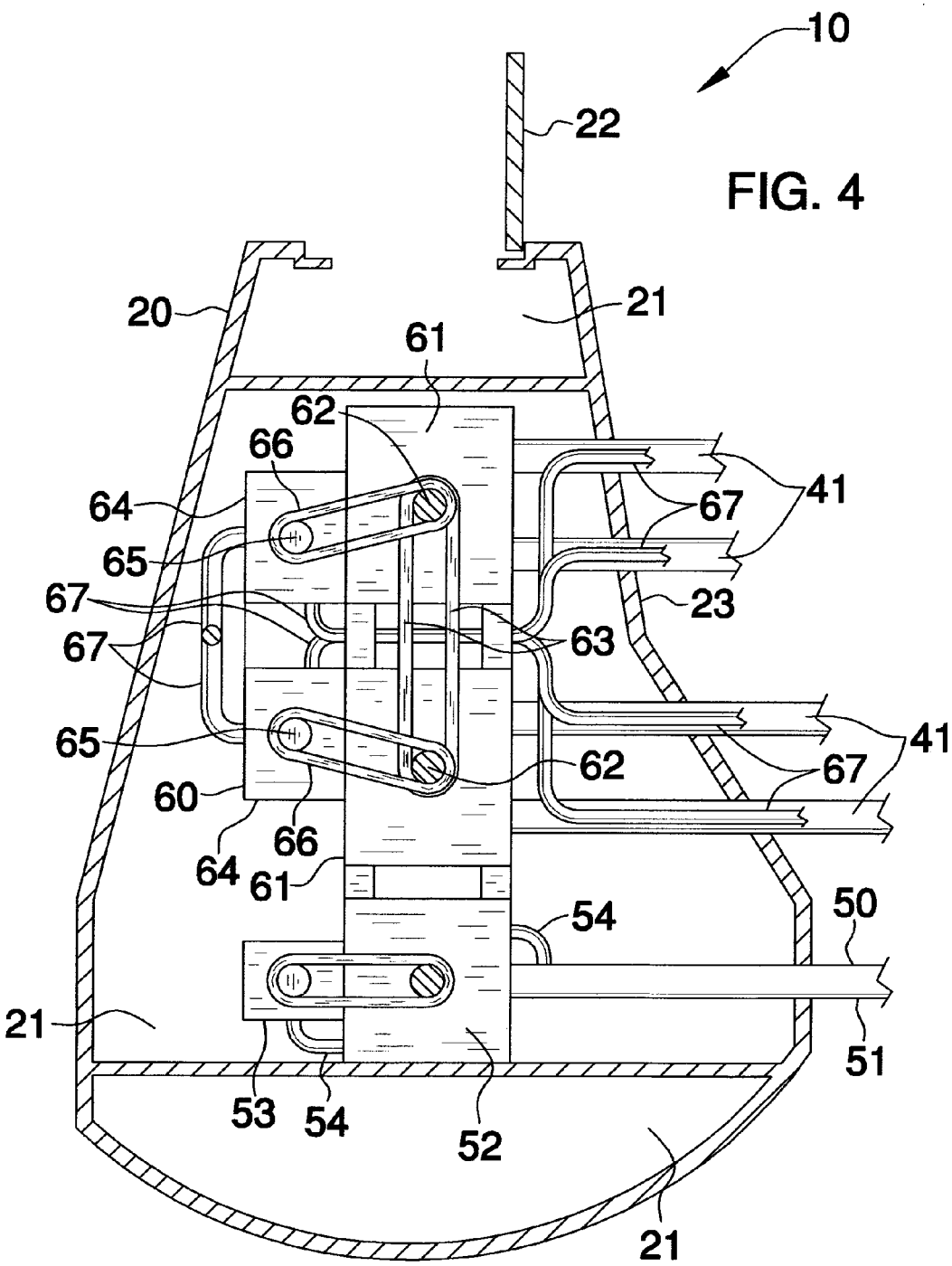
FIG. 4 is a cross-sectional view of the device shown in FIG. 1, taken along line 4—4.

Referring initially to FIG. 1, the device 10 includes a plurality of buoyant support members 20, consisting of a plurality of pontoons, sized and shaped for defining a plurality of respective elongated cavities 21 therein, as best shown in FIG. 4. Such support members 20 are adjustably positionable adjacent to the hull 31 while the boat 30 is situated in a body of water. The support members 20 are provided with a plurality of pivotal access panels 22 for conveniently allowing an operator to selectively access the cavities 21 as needed. Each of the support members 20 has a contoured inner surface 23 for effectively adapting to a general shape of the boat hull 31.

Figure 2:
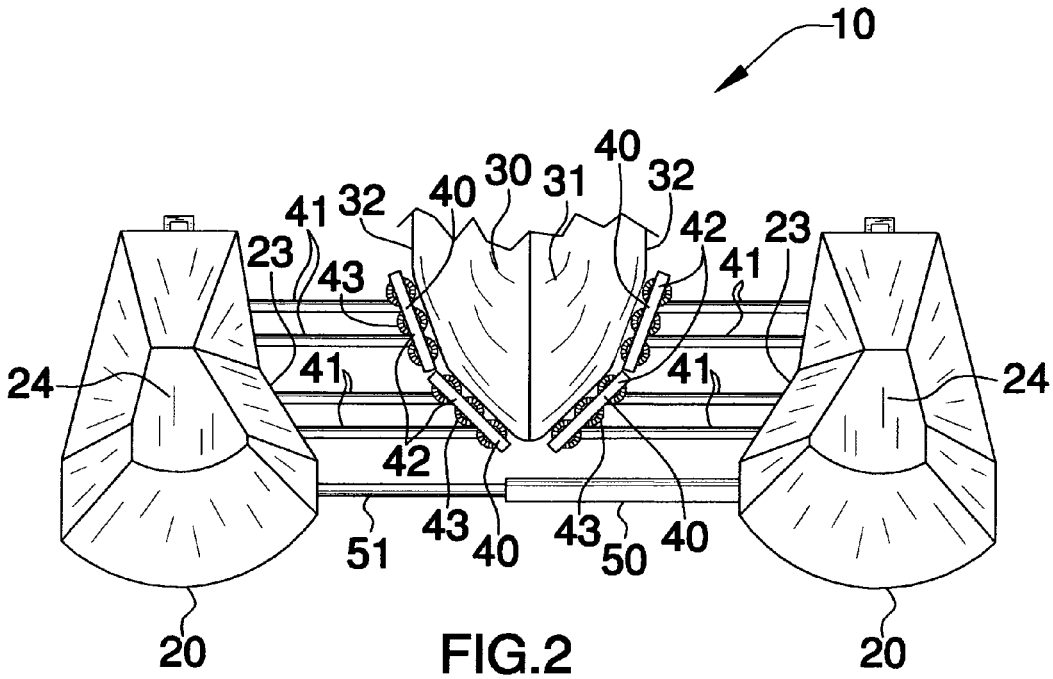
FIG. 2 is a front elevational view of the device shown in FIG. 1, showing the scrubber assemblies engaged about the hull of a boat.

Referring to FIGS. 2 and 4, a plurality of elongated rocker arms 41 and a plurality of associated scrubbing assemblies 40 are operably attached thereto. Such rocker arms 41 extend inwardly from the support members 20 and are selectively spaced along a longitudinal length thereof such that the scrubbing assemblies 40 can be effectively supported at front 24 and rear 25 end portions of the support members 20. The rocker arms 41 are laterally adjustable such that the scrubbing assemblies 40 can advantageously be positioned along alternating planes during operating conditions. This feature advantageously ensures that all surfaces of the hull 31 are engaged by the scrubbing assemblies 40 and thus performs a thorough cleaning of the same.

The scrubbing assemblies 40 include a plurality of adjustable panels 42 and a plurality of brushes 43 operably connected thereto. Such panels 42 are pivotal between a plurality of quadrants so that the brushes 43 can advantageously be adapted to the boat hull's 31 outer surface 32. The scrubbing assemblies 40 are independently operable such that an operator can effectively maintain continuous surface contact with the outer surface 32 during unstable swaying conditions, thus advantageously minimizing any chances of damage to the hull 31 through uncontrolled collisions.

Figure 3:
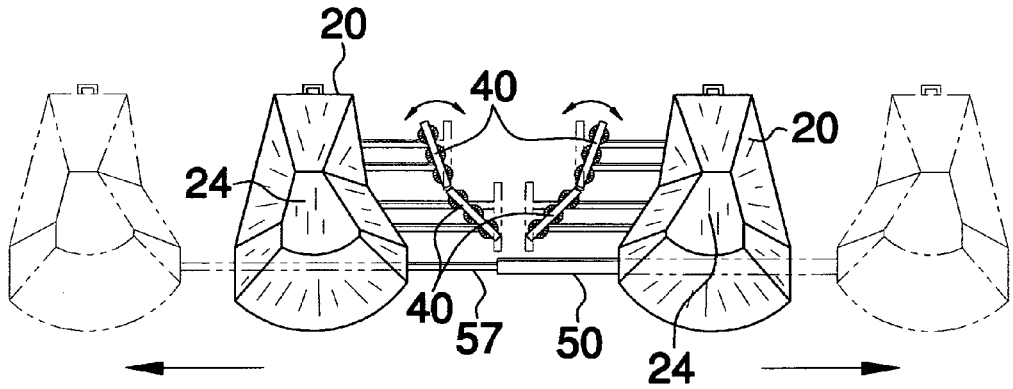
FIG. 3 is a front elevational view of the device shown in FIG. 1, showing the function of the hydraulic separators.

Referring to FIGS. 1, 2 and 3, a plurality of hydraulic separators 50 are positioned between the support members 20 adjacent to the front 24 and rear 25 end portions thereof. Such hydraulic separators 50 include associated pistons 51 secured to the support members 20 and telescopically extendable along a substantially horizontal plane such that a spatial relationship between the support members 20 can be selectively adjusted during operating conditions, as illustrated in FIG. 3. This feature advantageously allows the device 10 to accommodate boats 30 with hulls 31 of varying sizes. The separators 50 include a plurality of motors 52 and a plurality of pumps 53 operably connected thereto. Such pumps 53 cooperate with the motors 52 so that a predetermined volume of fluid is selectively deliverable to the separators 50 via a plurality of flexible lines 54 for effectively causing the pistons 51 to oscillate between extended and retracted positions during operating conditions. Since the apparatus 10 is employed in water the use of the separators 50 is always readily available.

Referring to FIG. 4, a mechanism 60 is included for effectively discharging a predetermined volume of fluid outwardly through the scrubbing assemblies 40 wherein fluid is directed laterally towards the boat hull 31 for advantageously assisting an operator to remove the debris therefrom without the need of manual labor. Such a discharging mechanism 60 is partially disposed within the cavities 21.

Still referring to FIG. 4, the discharging mechanism 60 includes a plurality of motors 61 that has a plurality of drive shafts 62 extending outwardly therefrom. A drive belt 63 is operably connected to the drive shafts 62 and a plurality of water pumps 64 having a plurality of driven shafts 65 connected thereto and positioned adjacent to the drive shafts 62 respectively. Such a mechanism 60 further includes a plurality of drive belts 66 operably connected to the driven shafts 65 and the drive shaft 62 respectively such that the driven shafts 65 are caused to operate in sync with the drive shafts 62 and a plurality of high-pressure water conduits 67 having opposed end portions in fluid communication with the water pumps 64 and the scrubbing members 43 respectively.

Referring to FIG. 1, the device 10 further includes a plurality of propeller engines 70 mounted adjacent to the rear end portions 25 of the support members 20 respectively. Advantageously, such engines 70 are for allowing an operator to effectively tow the boat 30 between remote locations during non-scrubbing conditions, thus conveniently eliminating the need for separate towing and washing devices which saves the boat owner a considerable amount of money. During towing procedures the support members 20 advantageously protects the boat hull 31 from damage due to collisions with a dock side, as often happens when maneuvering large vessels in small bodies of water.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for removing undesirable debris from a boat hull, said apparatus comprising:

a plurality of buoyant support members sized and shaped for defining a plurality of respective elongated cavities therein, said support members being adjustably positionable adjacent the hull while the boat is situated in a body of water, said support members being provided with a plurality of access panels for allowing an operator to selectively access the cavities as needed;

a plurality of rocker arms and a plurality of associated scrubbing assemblies operably attached thereto, said rocker arms extending inwardly from said support members and being selectively spaced along a longitudinal length thereof such that said scrubbing assemblies can be effectively supported front and rear end portions of said support members;

a plurality of hydraulic separators positioned between said support members adjacent said front and rear end portions thereof, said hydraulic separators including associated pistons telescopically extendable along a substantially horizontal plane such that a spatial relationship between said support members can be selectively adjusted during operating conditions; and means for discharging a predetermined volume of fluid outwardly through said scrubbing assemblies wherein the fluid is directed laterally towards the boat hull for assisting an operator to remove the debris therefrom, said discharging means being partially disposed within the cavities.

2. The apparatus of claim 1, wherein said discharging means comprises:

a plurality of motors having a plurality of drive shafts extending outwardly therefrom;

a drive belt operably connected to said drive shafts;

a plurality of water pumps having a plurality of driven shafts connected thereto and positioned adjacent to said drive shafts respectively;

a plurality of driven belts operably connected to said driven shafts and said drive shaft respectively such that said driven shafts are caused to operate in sync with said drive shafts; and a plurality of high-pressure water conduits having opposed end portions in fluid communication with said water pumps and said scrubbing members respectively.

3. The apparatus of claim 1, wherein said separators comprise:

a plurality of motors and a plurality of pumps operably connected thereto, said pumps for cooperating with said motors such that a predetermined volume of fluid is selectively deliverable to said separators via a plurality of flexible lines for causing said pistons to oscillate between extended and retracted positions during operating conditions.

4. The apparatus of claim 1, wherein said scrubbing assemblies comprise:

a plurality of adjustable panels and a plurality of brushes operably connected thereto, said panels being pivotal between a plurality of quadrants so that said brushes can be adapted to the boat hull's outer surface, said scrubbing assemblies being independently operable such that an operator can effectively maintain continuous surface contact with the outer surface during unstable swaying conditions.

5. The apparatus of claim 1, further comprising:

a plurality of propeller engines mounted adjacent to said rear end portions of said support members respectively, said engines for allowing an operator to effectively tow the boat between remote locations during non-scrubbing conditions.

6. The apparatus of claim 1, wherein said support members comprise: a plurality of pontoons.

7. An apparatus for removing undesirable debris from a boat hull, said apparatus comprising:

a plurality of buoyant support members sized and shaped for defining a plurality of respective elongated cavities therein, said support members being adjustably positionable adjacent the hull while the boat is situated in a body of water, said support members being provided with a plurality of pivotal access panels for allowing an operator to selectively access the cavities as needed, each said support member having a contoured inner surface for adapting to a general shape of the boat hull;

a plurality of elongated rocker arms and a plurality of associated scrubbing assemblies operably attached thereto, said rocker arms extending inwardly from said support members and being selectively spaced along a longitudinal length thereof such that said scrubbing assemblies can be effectively supported front and rear end portions of said support members;

a plurality of hydraulic separators positioned between said support members adjacent said front and rear end portions thereof, said hydraulic separators including associated pistons secured to said support members and telescopically extendable along a substantially horizontal plane such that a spatial relationship between said support members can be selectively adjusted during operating conditions; and means for discharging a predetermined volume of fluid outwardly through said scrubbing assemblies wherein the fluid is directed laterally towards the boat hull for assisting an operator to remove the debris therefrom, said discharging means being partially disposed within the cavities.

8. The apparatus of claim 7, wherein said discharging means comprises:

a plurality of motors having a plurality of drive shafts extending outwardly therefrom;

a drive belt operably connected to said drive shafts;

a plurality of water pumps having a plurality of driven shafts connected thereto and positioned adjacent to said drive shafts respectively;

a plurality of driven belts operably connected to said driven shafts and said drive shaft respectively such that said driven shafts are caused to operate in sync with said drive shafts; and a plurality of high-pressure water conduits having opposed end portions in fluid communication with said water pumps and said scrubbing members respectively.

9. The apparatus of claim 7, wherein said separators comprise:

a plurality of motors and a plurality of pumps operably connected thereto, said pumps for cooperating with said motors such that a predetermined volume of fluid is selectively deliverable to said separators via a plurality of flexible lines for causing said pistons to oscillate between extended and retracted positions during operating conditions.

10. The apparatus of claim 7, wherein said scrubbing assemblies comprise:

a plurality of adjustable panels and a plurality of brushes operably connected thereto, said panels being pivotal between a plurality of quadrants so that said brushes can be adapted to the boat hull's outer surface, said scrubbing assemblies being independently operable such that an operator can effectively maintain continuous surface contact with the outer surface during unstable swaying conditions.

11. The apparatus of claim 7, further comprising:

a plurality of propeller engines mounted adjacent to said rear end portions of said support members respectively, said engines for allowing an operator to effectively tow the boat between remote locations during non-scrubbing conditions.

12. The apparatus of claim 7, wherein said support members comprise: a plurality of pontoons.

13. An apparatus for removing undesirable debris from a boat hull, said apparatus comprising:

a plurality of buoyant support members sized and shaped for defining a plurality of respective elongated cavities therein, said support members being adjustably positionable adjacent the hull while the boat is situated in a body of water, said support members being provided with a plurality of pivotal access panels for allowing an operator to selectively access the cavities as needed, each said support member having a contoured inner surface for adapting to a general shape of the boat hull;

a plurality of elongated rocker arms and a plurality of associated scrubbing assemblies operably attached thereto, said rocker arms extending inwardly from said support members and being selectively spaced along a longitudinal length thereof such that said scrubbing assemblies can be effectively supported front and rear end portions of said support members, said rocker arms being laterally adjustable such that said scrubbing assemblies can be positioned along alternating planes during operating conditions;

a plurality of hydraulic separators positioned between said support members adjacent said front and rear end portions thereof, said hydraulic separators including associated pistons secured to said support members and telescopically extendable along a substantially horizontal plane such that a spatial relationship between said support members can be selectively adjusted during operating conditions; and means for discharging a predetermined volume of fluid outwardly through said scrubbing assemblies wherein the fluid is directed laterally towards the boat hull for assisting an operator to remove the debris therefrom, said discharging means being partially disposed within the cavities.

14. The apparatus of claim 13, wherein said discharging means comprises:

a plurality of motors having a plurality of drive shafts extending outwardly therefrom;

a drive belt operably connected to said drive shafts;

a plurality of water pumps having a plurality of driven shafts connected thereto and positioned adjacent to said drive shafts respectively;

a plurality of driven belts operably connected to said driven shafts and said drive shaft respectively such that said driven shafts are caused to operate in sync with said drive shafts; and a plurality of high-pressure water conduits having opposed end portions in fluid communication with said water pumps and said scrubbing members respectively.

15. The apparatus of claim 13, wherein said separators comprise:

a plurality of motors and a plurality of pumps operably connected thereto, said pumps for cooperating with said motors such that a predetermined volume of fluid is selectively deliverable to said separators via a plurality of flexible lines for causing said pistons to oscillate between extended and retracted positions during operating conditions.

16. The apparatus of claim 13, wherein said scrubbing assemblies comprise:

a plurality of adjustable panels and a plurality of brushes operably connected thereto, said panels being pivotal between a plurality of quadrants so that said brushes can be adapted to the boat hull's outer surface, said scrubbing assemblies being independently operable such that an operator can effectively maintain continuous surface contact with the outer surface during unstable swaying conditions.

17. The apparatus of claim 13, further comprising:

a plurality of propeller engines mounted adjacent to said rear end portions of said support members respectively, said engines for allowing an operator to effectively tow the boat between remote locations during non-scrubbing conditions.

18. The apparatus of claim 13, wherein said support members comprise: a plurality of pontoons.

* * * * *